US010703600B2

(12) United States Patent
Behrendt

(10) Patent No.: US 10,703,600 B2
(45) Date of Patent: Jul. 7, 2020

(54) FLOATING WATER MAT REEL

(71) Applicant: David Donald Behrendt, Dunlap, IA (US)

(72) Inventor: David Donald Behrendt, Dunlap, IA (US)

(73) Assignee: David Donald Behrendt, Dunlap, IA (US)

( * ) Notice: Subject to any disclaimer, the term of this patent is extended or adjusted under 35 U.S.C. 154(b) by 279 days.

(21) Appl. No.: 15/726,630

(22) Filed: Oct. 6, 2017

(65) Prior Publication Data

US 2018/0251334 A1 Sep. 6, 2018

Related U.S. Application Data

(60) Provisional application No. 62/466,577, filed on Mar. 3, 2017.

(51) Int. Cl.

| | |
|---|---|
| ***B65H 75/22*** | (2006.01) |
| ***B65H 75/28*** | (2006.01) |
| ***B65H 18/02*** | (2006.01) |
| ***B65H 75/24*** | (2006.01) |
| ***B65H 18/10*** | (2006.01) |
| ***B63B 34/00*** | (2020.01) |

(52) U.S. Cl.

CPC ..... *B65H 75/22* (2013.01); *B65H 18/028* (2013.01); *B65H 75/241* (2013.01); *B65H 75/28* (2013.01); *B65H 75/285* (2013.01); *B63B 34/00* (2020.02); *B65H 18/10* (2013.01); *B65H 2301/41427* (2013.01); *B65H 2701/1922* (2013.01)

(58) Field of Classification Search

CPC .... B65H 75/22; B65H 75/285; B65H 18/028; B65H 18/10; B65H 2301/41427; B65H 2701/1922; B65H 75/241; B65H 75/28; B65H 75/18; B65H 75/30; B65H 2701/1133; B63B 35/73

See application file for complete search history.

(56) References Cited

U.S. PATENT DOCUMENTS 3,979,782 A * 9/1976 Lamb ..... E04H 4/10 4/502
4,103,368 A * 8/1978 Lockshaw ..... E04H 4/103 126/566
4,324,370 A * 4/1982 Guard ..... E04H 4/101 242/403
4,328,930 A * 5/1982 Kalendovsky ..... B65H 16/06 242/406
4,407,027 A * 10/1983 Colon, Jr. ..... E04H 4/101 188/382
4,459,711 A * 7/1984 Sartain ..... E04H 4/101 4/498
4,551,127 A * 11/1985 Rich ..... A63H 33/04 242/546.1
4,666,100 A * 5/1987 Price ..... B65H 75/28 242/578
4,681,482 A * 7/1987 Arciszewski ..... E01C 19/522 14/2.4

(Continued)

*Primary Examiner* — William A. Rivera
(74) *Attorney, Agent, or Firm* — Zarley Law Firm, P.L.C.

(57) ABSTRACT

A floating water mat reel that has a plurality of plates mounted to an axle. A floating water mat is selectively connected to the plates. A crank, connected to the axle is used to rotate the plates so that the mat wraps around the plate.

17 Claims, 4 Drawing Sheets

(56) References Cited

U.S. PATENT DOCUMENTS

| | | | | | |
|---|---|---|---|---|---|
| 4,955,092 | A * | 9/1990 | Hagan | E04H 4/101 | 242/390.8 |
| 4,972,529 | A * | 11/1990 | Wolfson, Jr. | E04H 4/101 | 4/500 |
| 5,107,552 | A * | 4/1992 | Lavalliere | E04H 4/101 | 4/498 |
| 5,184,356 | A * | 2/1993 | Lof | E04H 4/101 | 4/498 |
| 5,374,008 | A * | 12/1994 | Halvorson | A47K 10/40 | 242/598.3 |
| 5,425,143 | A * | 6/1995 | Kalandovsky | E04H 4/101 | 242/388.6 |
| 5,810,281 | A * | 9/1998 | Kole | B65H 75/22 | 242/532.6 |
| D645,162 | S * | 9/2011 | Martell | D25/2 | |
| 2014/0034771 | A1* | 2/2014 | Hecker | B65H 49/325 | 242/395 |

* cited by examiner

FLOATING WATER MAT REEL

CROSS REFERENCE TO RELATED APPLICATION

This application claims the benefit to Provisional Application U.S. Ser. No. 62/466,577 filed on Mar. 3, 2017.

BACKGROUND OF THE INVENTION

This invention is directed to a reel for a floating water mat, and more particularly to a floating water mat reel for a boat.

Floating water mats are well known in the art for recreational and entertainment uses. Typically, floating water mats are attached to a dock or boat when in use. When individuals are finished using the mats, because of their size, as well as their position relative to a dock or boat, the mats are challenging to remove. In addition, once removed, the mats are challenging to roll for storage. Therefore, a device is needed that addresses these deficiencies.

An objective of the present invention is to provide a reel that makes rolling up a mat easier.

Another objective of the present invention is to provide a reel that is easy to assemble and take apart.

These and other objectives will be apparent to one skilled in the art based upon the following written description, drawings, and claims.

SUMMARY OF THE INVENTION

A floating water mat reel includes a plurality of plates connected to an axle. A floating water mat is selectively connected to the plates. Preferably, the plates have a slot that receives and frictionally engages an end of the floating water mat. Further, preferred is that the axle has a plurality of axle sections that are easily connected to the plates so that the reel is quickly assembled and disassembled.

A crank is connected to the axle which rotates the axle and the plates. As the plates rotate the mat wraps around the plates.

DETAILED DESCRIPTION OF THE PREFERRED EMBODIMENTS

Figure 1:
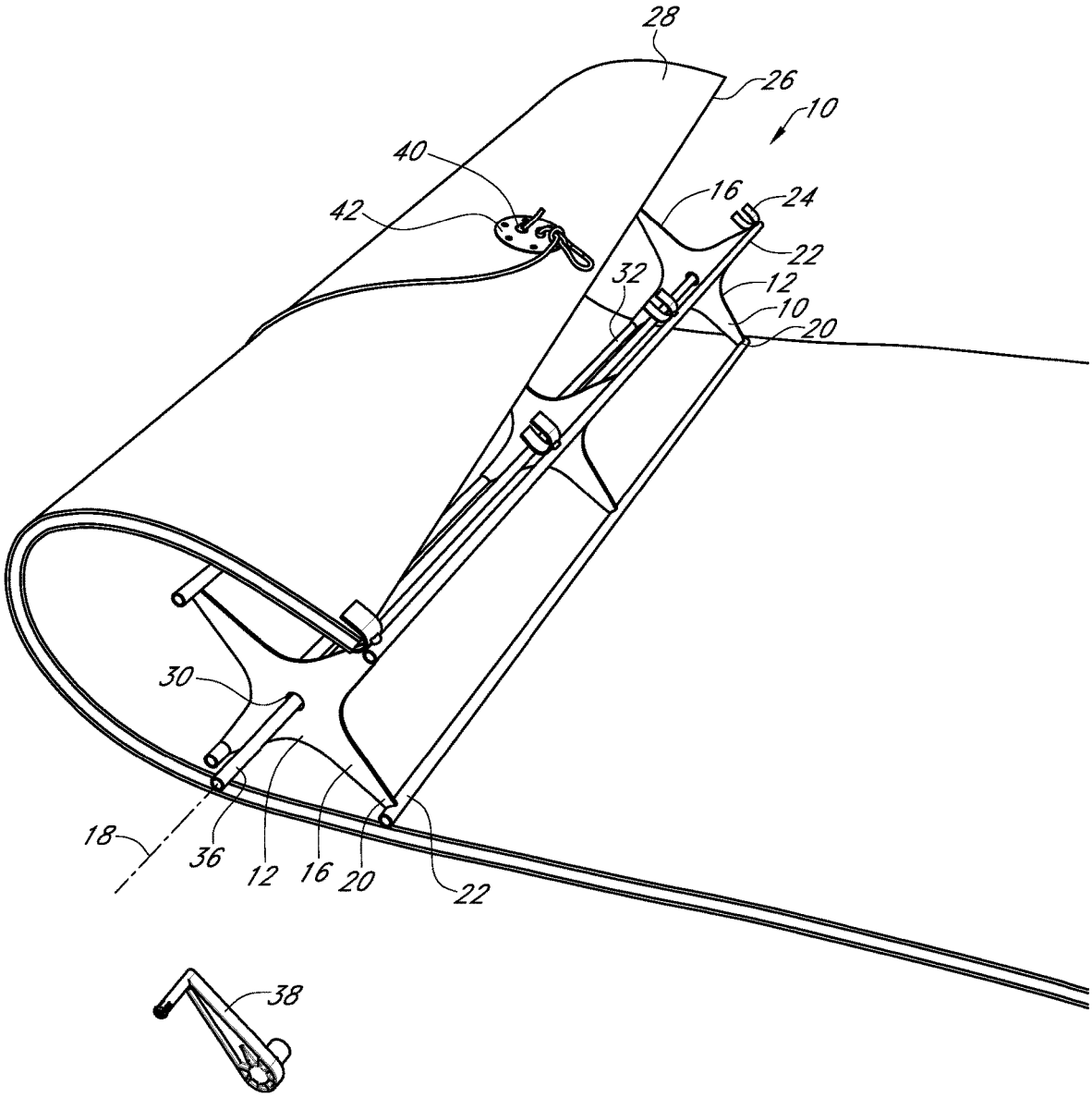
FIG. 1 is a perspective view of a floating water mat reel.
Figure 2:
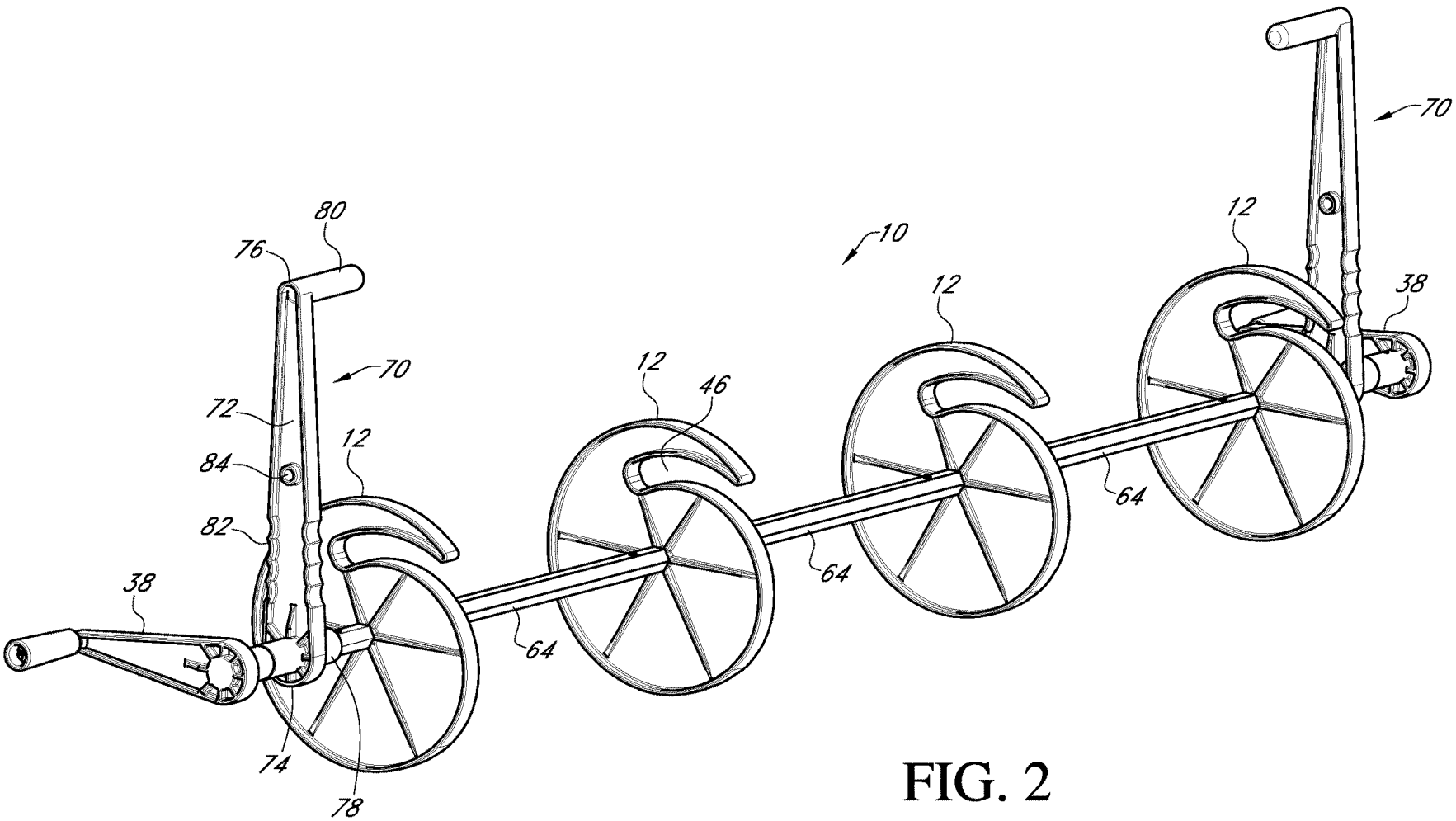
FIG. 2 is a perspective view of a floating water mat reel.
Figure 3:
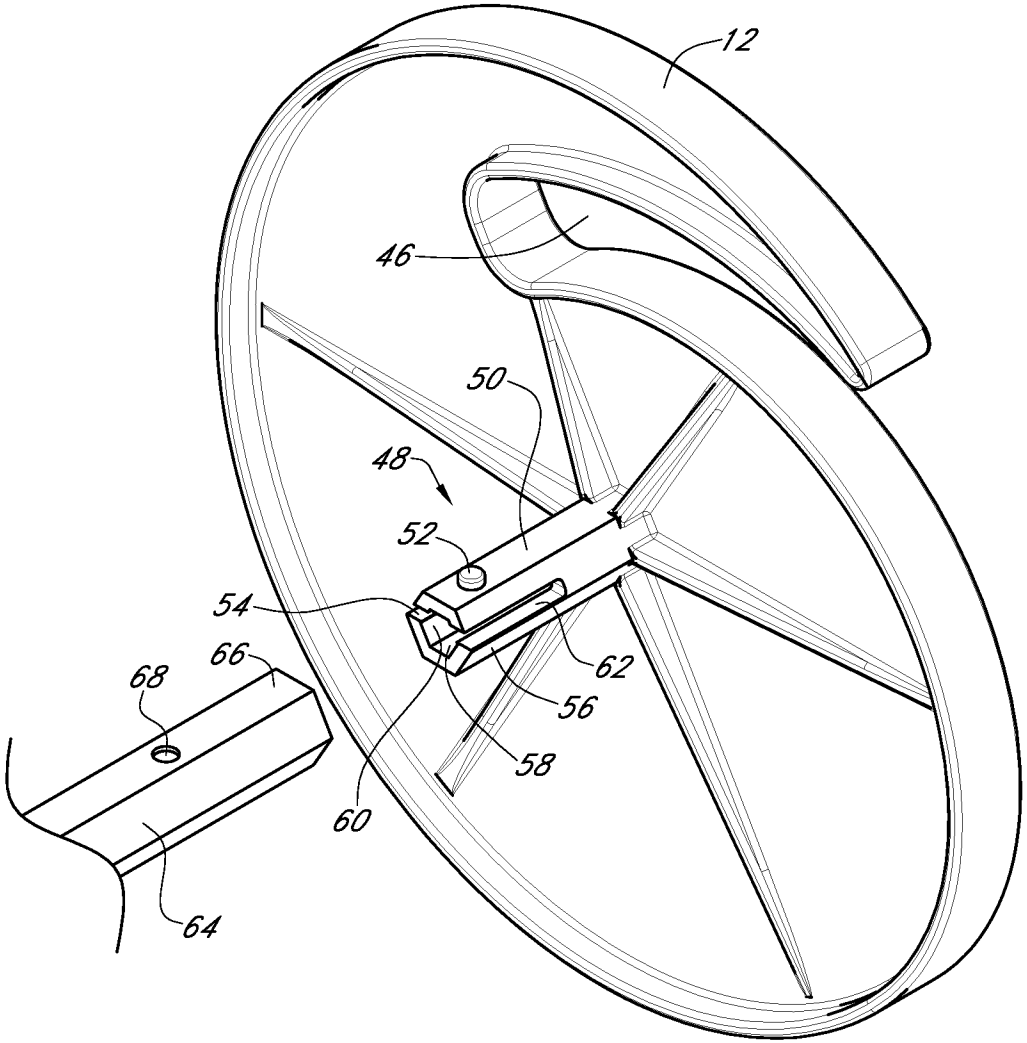
FIG. 3 is a perspective view of a plate with an axle receiver.
Figure 4:
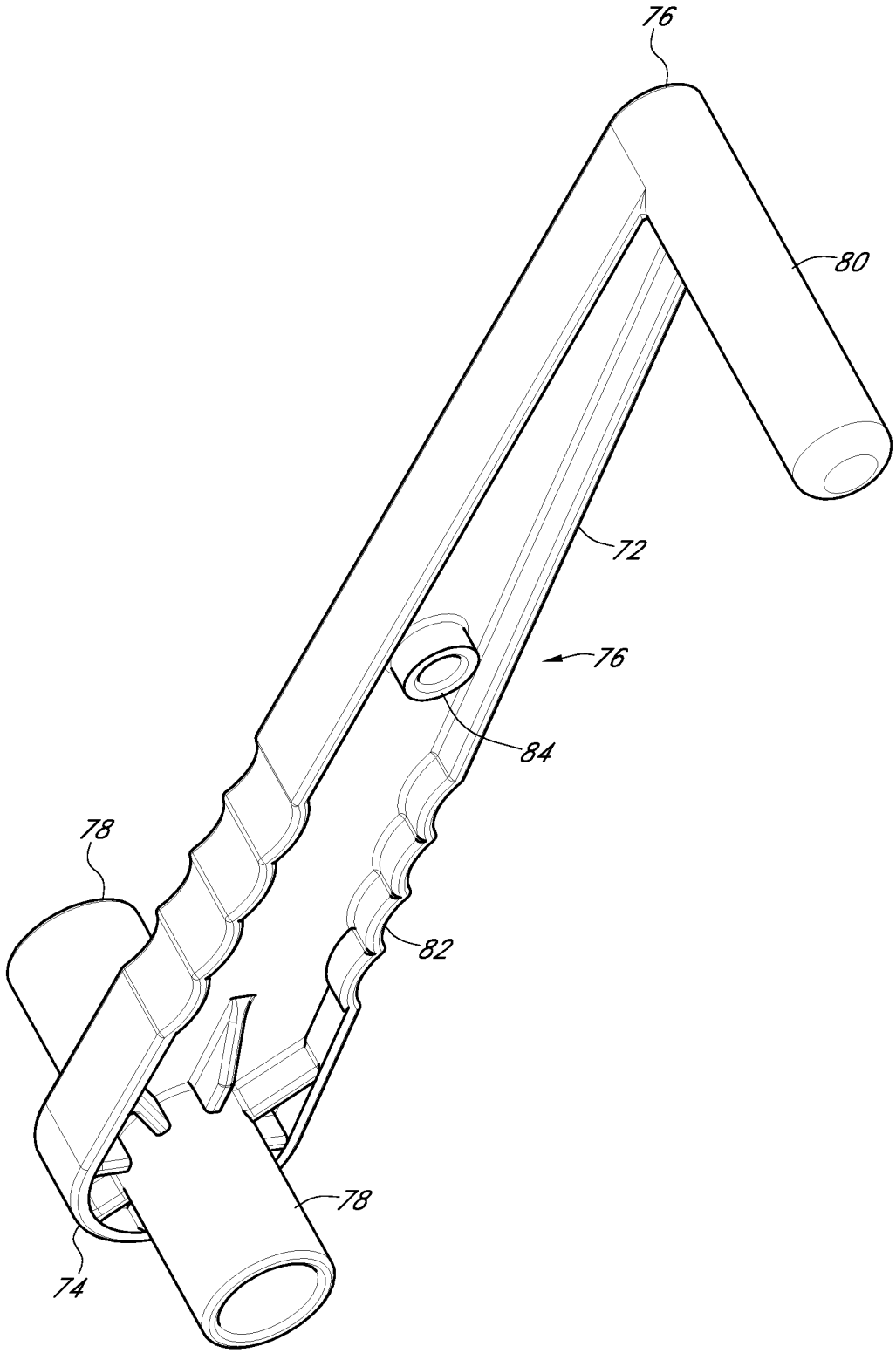
FIG. 4 is a perspective view of a support member.

Referring to the Figures, a floating water mat reel 10 includes a pair of end plates 12 and a center plate 14 positioned between the end plates 12. The plates 12 and 14 are of any size, shape and structure. In a preferred embodiment the plates 12 and 14 have a plurality of fingers 16 that extend radially outward from a central axis 18 of the plates 12 and 14. The fingers 16 of plates 12 and 14 are horizontally aligned.

Connected to the outer end or tip 20 of the fingers are a plurality of support rods 22. The support rods 22 extend from one end plate 12 to the other end plate 12. Connected to at least one of the support rods 22 are a plurality of receiving members 24 that are formed and positioned to receive one end 26 of a floating mat 28.

Extending through central openings 30 in plates 12 and 14 and connected to plates 12 and 14 is an axle 32. In a preferred embodiment, the axle 32 has a central elongated member 34 and a pair of outer members 36 that are slidably and telescopically connected to the central elongated member 34. Removably attached to at least one end of the end members 36 is a hand crank 38. Also, connected to the end members 36 are a pair of ropes, straps, or the like 40 that are used to connect the reel 10 to a boat or dock.

In an alternative embodiment, a plate 42 is secured to the end 26 of the floating mat 28. Attached to the plate 42 is a hook (not shown) that connects to one of the supporting rods 22.

In operation, the floating mat 28 is connected to the reel 10 using the receiving members 24 or hook (not shown). Once attached, the crank 38 is attached to an end member 36. Using manual force, the reel 10 is rotated so that the mat 28 wraps around the reel 10. When not in use, the end members 36 are slid inwardly toward the center plate 14 so that they barely extend beyond the outer plates 12.

In an alternative embodiment, the plates 12 have a slot 46 that is preferably arcuate. The slot 46 is configured to frictionally receive and retain end 26 of the floating mat 28. The plates 12 also have a centrally located axle receiver 48. The axle receiver 48 is of any size, shape, and structure. In one example shown, the axle receiver 48 has a top member 50 having a detent 52 that extends outwardly from the plate 12. A bottom surface 54 of the top member 50 is arcuate or angled to coincide with the shape of the axle 32. The axle receiver 48 also has a bottom member 56 that extends outwardly from the plate 12 and a top surface 58 configured to coincide with the shape of the axle 32. The axle receiver 48 has an open end 60 and a space 62 between the top member 50 and the bottom member 56.

The axle 32 is comprised of a plurality of axle sections 64. The ends 66 of each section 64 have an opening 68 that receives the detent 52 of the axle receiver 48. The ends 66 of the sections 64 are also configured to be received and retained by the axle receiver 48.

Mounted to the outer members 36 are a pair of support members 70. The support members 70 are of any size, shape or structure. In one example the support members are comprised of an elongated member 72 having a first end 74 and a second end 76. The first end 74 has a pair of mounting cylinders 78 for connecting the members 72 to outer members 36 and to crank 38. The second end 76 has a transverse member 80 for assisting in carrying the reel 10. In between the first end 74 and the second end 76 is a gripping section 82. Also the elongated member 72 has a hole 84 for receiving a strap 40.

In operation, end 26 of mat 28 is inserted into slots 46 of plates 12 and frictionally retains the mat 28. Using the support member 70 for leverage with one hand on the gripping section 82 and the transverse member 80 supporting an arm or elbow, the crank is rotated, which in turn rotates the axle 32 and plates 12. The rotation of the plates 12 causes the mat 28 to wrap around the plates.

Accordingly, a floating water mat reel has been disclosed that at the very least meets all the stated objectives.

What is claimed is:

1. A floating water mat reel comprising:

a plurality of plates mounted to an axle;

the plurality of plates having centrally located axle receivers that extend outwardly from the plurality of plates;

the axle receivers each having a top member having a bottom surface configured to coincide with the shape of the axle and a bottom member having a top surface configured to coincide with the shape of the axle;

the axle receivers having an open end and a space extending between the top member and the bottom member;

the axle having an opening that receives the axle receiver;

a floating water mat selectively connected to the plurality of plates; and a hand crank connected to the axle.

2. The reel of claim 1 wherein the plurality of plates have a slot that frictionally engage the floating water mat.

3. The reel of claim 1 wherein the plates have a plurality of fingers extending outwardly from a central axis to outer ends.

4. The reel of claim 3 wherein support rods extend between and are connected to the outer ends of the plates.

5. The reel of claim 4 wherein a plurality of receiving members are connected to at least one of the plurality of support rods.

6. The reel of claim 5 wherein the plurality of receiving members are configured to receive one end of a floating mat.

7. The reel of claim 3 wherein the plurality of fingers are horizontally aligned with the plurality of fingers on each of the plurality of plates.

8. The reel of claim 1 wherein the axle is comprised of a plurality of axle sections.

9. The reel of claim 8 further comprising at least one of the plurality of axle sections having the opening that receives a detent of another of the axle receiver, wherein the plurality of receiving members are configured to receive and retain at least an end of at least one of the plurality of axle sections being configured to be received.

10. The reel of claim 1 wherein a plurality of support members are connected to outer ends of the axle.

11. The reel of claim 10 further comprising each support member comprising an elongated member having a hole for receiving a strap, a first end, and a second end, wherein the first end has a pair of mounting cylinders configured to connect to a pair of outer members of the axle and the second end having a transverse member configured to assist in carrying the reel.

12. The reel of claim 10 further comprising each support member comprising an elongated member having a first end and a second end with a gripping section between the first end and the second end.

13. The reel of claim 1 wherein the plurality of plates comprises a pair of end plates and a center plate positioned between the pair of end plates.

14. The reel of claim 1 wherein the axle has a central elongated member and a pair of outer members that are slidably and telescopically connected to the central elongated member.

15. The reel of claim 14 further comprising a strap connected to each of the outer members, wherein the pair of straps are configured to connect the reel to a boat.

16. The reel of claim 1 wherein the hand crank is removably connected to the axle.

17. A floating water mat reel comprising:

a plurality of plates mounted to an axle, wherein the axle is comprised of a plurality of axle sections;

the plurality of plates having axle receivers that extend outwardly from the plurality of plates;

a floating water mat selectively connected to the plurality of plates;

a hand crank connected to the axle; and at least one of the plurality of axle sections having an opening that receives a detent of another of the axle receiver, wherein the plurality of receiving members are configured to receive and retain at least an end of at least one of the plurality of axle sections being configured to be received.

* * * * *